United States Patent [19]

Penchenier

[11] Patent Number: 4,474,444

[45] Date of Patent: Oct. 2, 1984

[54] METHOD AND APPARATUS FOR PROCESSING PHOTOGRAPHIC MATERIALS BY TRANSFERRING PROCESSING LIQUIDS ONE BY ONE TO A PROCESSING RECEPTACLE

[76] Inventor: Jean-Marie Penchenier, 25, rue d'Alsace, 75010 Paris, France

[21] Appl. No.: 318,337

[22] Filed: Nov. 5, 1981

[30] Foreign Application Priority Data

Nov. 19, 1980 [FR] France ..... 80 24541

[51] Int. Cl.³ ..... G03D 3/02

[52] U.S. Cl. ..... 354/299; 354/312; 354/327; 354/329

[58] Field of Search ..... 354/312, 313, 315, 316, 354/323, 327, 329, 330, 331, 337, 324, 299; 355/27

[56] References Cited

U.S. PATENT DOCUMENTS

| | | | |
|---|---|---|---|
| 3,668,997 | 6/1972 | Ratowsky | 354/330 |
| 3,982,259 | 9/1976 | Baerle | 354/329 |
| 4,134,665 | 1/1979 | Wada et al. | 354/324 |
| 4,198,153 | 4/1980 | Hamlin | 354/327 |
| 4,277,159 | 7/1981 | Descotes | 354/312 |

FOREIGN PATENT DOCUMENTS 489835 6/1970 Switzerland .

*Primary Examiner*—A. A. Mathews

*Attorney, Agent, or Firm*—Brisebois & Kruger

[57] ABSTRACT

Materials such as photographic material is processed by supplying successive processing liquid baths to a processing receptacle. These baths are initially filled into a first series of receptacles and are simultaneously transferred to a second series of receptacles, one of which is the processing receptacle, by simultaneously tilting all the first receptacles. The second receptacles are then moved to a position in which their liquid contents are transferred back to the first receptacles, in each instance, one receptacle downstream from the receptacle from which the liquid was received by the second receptacles. The receptacles can take the form of cylindrical containers or tanks of a common body. The arrangement permits premeasuring the needed chemical liquids into the first receptacles and permits transferring the liquids one by one to the processing receptacle by simple movements of the body either in subdued light or in full light, where the processing receptacle is a light-tight compartment of the body.

15 Claims, 11 Drawing Figures

Figure 1:
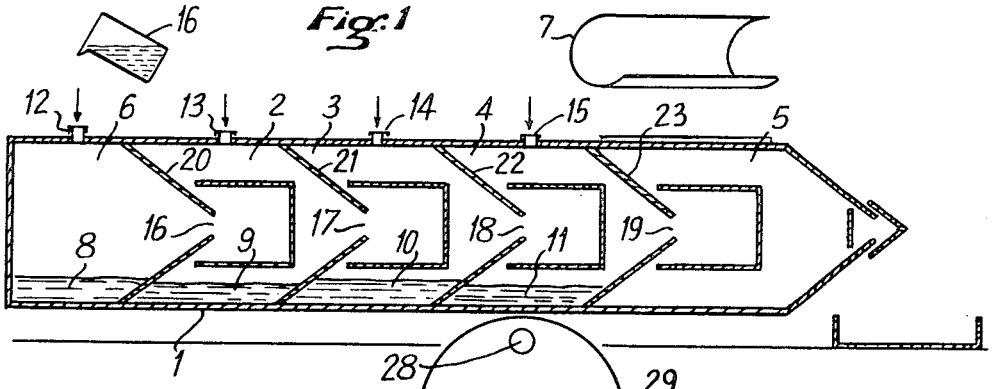

METHOD AND APPARATUS FOR PROCESSING PHOTOGRAPHIC MATERIALS BY TRANSFERRING PROCESSING LIQUIDS ONE BY ONE TO A PROCESSING RECEPTACLE

This invention relates to a method and apparatus for the colour processing of positive or negative material. The processing of colour paper requires a total absence of light, and the temperature of the developers to be constant to within half a degree centigrade.

By using special developing tanks these difficulties can be overcome but, however careful the handling of non-automatic manipulations is, the risks of obtaining an imperfect result are as great as the number of elementary operations.

These operations consist in particular in the preparation of baths, in maintaining their temperature at a given degree, in processing the photo-graphic material in complete black-out conditions, in absolutely limiting to an accurately specified period the time spent in agitating the developing tanks in pouring a second bath, then a third one followed by several washings and finally by a stabiliser, all these baths requiring a specific temperature.

These numerous operations require constant supervision. In addition their overall length renders this process unserviceable as soon as the photographic material to be processed exceeds a certain quantity.

The least costly machines, capable of producing only a low output, consist in a developing tank inside which a drum carrying the photographic material revolves, the developing tank being automatically drained off after each bath. This process suffers from the disadvantage that it wastes baths in large quantities considering the size of the developing tank.

There are other processing machines in which the photographic material is automatically carried between rollers from one bath to another, but these machines have various drawbacks: either they are bulky, or they use processing liquids which are not automatically changed, so that the quality of the last batch of prints may be poorer. In brief, present machines are costly, bulky, or fragile as their distributing sluices can easily become corroded. Such machines are all the more complex in that they must make allowance for programming up to nine different releasing operations.

The colour proof processing of films or paper, the subject-matter of this invention, is distinguished by the fact that the processing liquids are first poured into adjacent tanks or receptacles, the photographic material being placed in the end tank or receptacle, and by the fact that each bath-changing operation of the end tank is accomplished by a simultaneous transfer of the liquid chemicals from one tank to the adjacent tank next following, simply through the temporary tilting of the tanks as a unit, the bath of the tank where the photographic material has been placed being drained off during the transfer operation to make room for its replacement when the tanks are tilted back to their original position.

Such a process has the double advantage of being able to preserve all the advantages that simple developing tanks have as well as those of the revolving developing tanks where the liquid chemical is gently and efficiently agitated over the the photographic material being processed; at the same time it removes the disadvantages inherent in the previous methods which use automatic sluices for charging with processing liquid.

Indeed, contrary to the previous methods, all the baths are initially introduced into their compartments without having to use sluices when changing the liquid chemical.

Another aspect of the invention is an apparatus implementing the aforesaid method, and distinguished by the fact that it comprises a partitioned body which can be tilted and each intermediate compartment or receptacle and is fitted with an aperture through which a specific bath can be introduced, and fitted with an internal temporary-holding tank or receptacle whose opening is such that when the body is tilted, it is only filled by the draining off of the preceding compartment through an aperture in the internal partition separating the two adjacent compartments, and is only emptied into the compartment which houses it when the body is returned to its nontilted position.

Thus, tilting the whole of the partitioned body is enough to automatically transfer into or fill into the adjacent temporary-holding tanks the totality of the chemical liquids initially introduced into each compartment through the aperture in the external wall of the partitioned body, the aforesaid temporary-holding tanks acting as obstacles to any mixing of the liquid chemicals during the tilting of the body, the partition-walls of the compartments themselves acting as obstacles to any mixing of the liquid chemicals whenever in non-tilted positions.

Another aspect of the invention is an apparatus of this type the last compartment of which comprises all the introductory apparatus of the photographic material to be processed and an opening for the discharge of baths, provided with deflectors protecting it from any kind of light in such a way that, once loaded, the device as a whole can be operated in fully lighted conditions. Therefore, all that is necessary, once the photographic material which is to be processed has been introduced in the last compartment, is to pour, in full light, the successive baths from the first to the penultimate compartment and to tilt the whole apparatus a first time, then tilt it back to its initial position, ensuring that the first bath has been introduced in the compartment containing the photographic material; then, after waiting the necessary time allotted for the first bath, all that is needed is to tilt the apparatus a second time to allow the first bath to drain off and to be replaced by the second one when the apparatus is returned to its initial position.

Such simplicity makes it easy to achieve automated tilting operations, each taking place after a well defined period of time related to the bath in question.

Moreover, one can take advantage of the rotating motion given to the tilting body around its axis to reduce the risk that small amounts of liquid chemical will flow back after having been discharged during the tilting of the body. This is achieved by partly blocking the temporary-holding tanks and by fitting them out with at least one internal pale or wall which forces the chemical contained to discharge itself from the temporary-holding tank during the rotation of the body when in its non-tilted position.

Finally, once the body is charged with the whole amount of processing liquids, one takes advantage of the compactness of the whole unit and of the rotating motion to maintain the temperature of the baths by partially immersing the tilting unit into a water-bath kept at a constant temperature, the unit being fitted out with little longitudinal blades in such a way that they maintain a thin layer of water constantly renewed at a given temperature. Thus, contrary to ordinary tanks whose side situated outside the bath is submitted to sudden variations of temperature, the process is permanently protected by a layer of water whose variation of temperature during movement is much less than the sudden variation of temperature of the environment outside the water-bath.

Thus, an extremely simple and efficient apparatus, whose length does not exceed that of ordinary devices, is provided. Moreover, though the quality of the processed prints is equal to that obtained from complex drum-operated machines, maintenance is minimal as the apparatus does not require a pump, or any sluice, and as any motor that might eventually drive the unit is placed on the outside, it is possible easily to control the even distribution of the liquid chemicals at any time during processing.

It is clear that the process and the apparatus thus defined can be used in many different ways. Indeed, as the process is particularly applicable to positive papers for the colour reproduction of documents which are brightly lit on a copying-bed, the apparatus for the implementation of the process can be adapted to this kind of paper.

Besides, all developing operations are made possible in day light by the insertion of the photographic material, before being exposed, into a re-usable or disposable light-tight box which is then placed in the end compartment of the apparatus, the box acting as a screen against the light and as a receptacle for the bath.

Other advantages and features are disclosed in the course of the following description. It refers to the accompanying drawings representing a non-limiting example of one type of construction of the apparatus for the implementation of the invention. One possible variant is also illustrated in FIG. 4.

Figure 2:
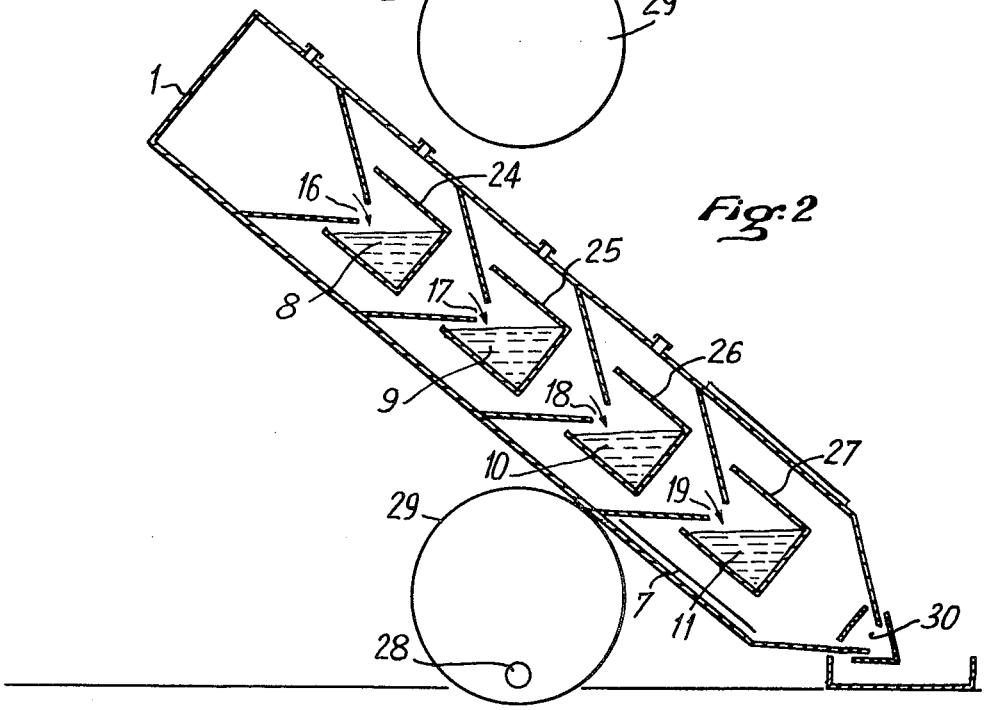
Figure 3:
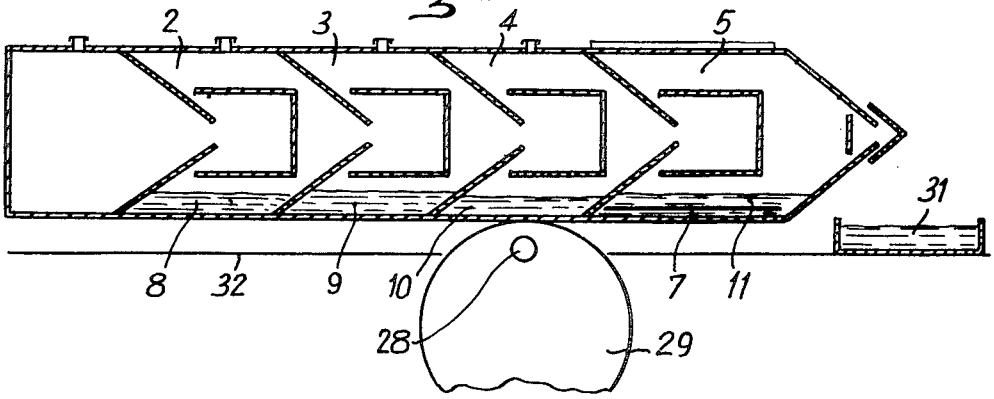
Figure 4:
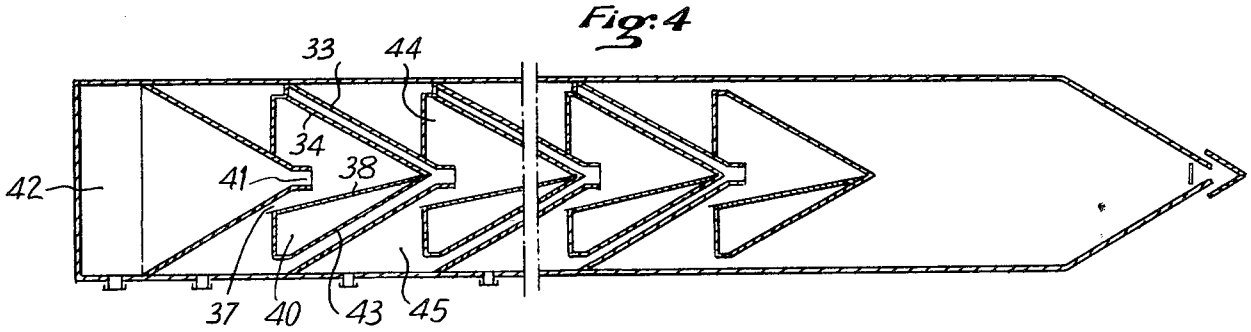
Figure 6:
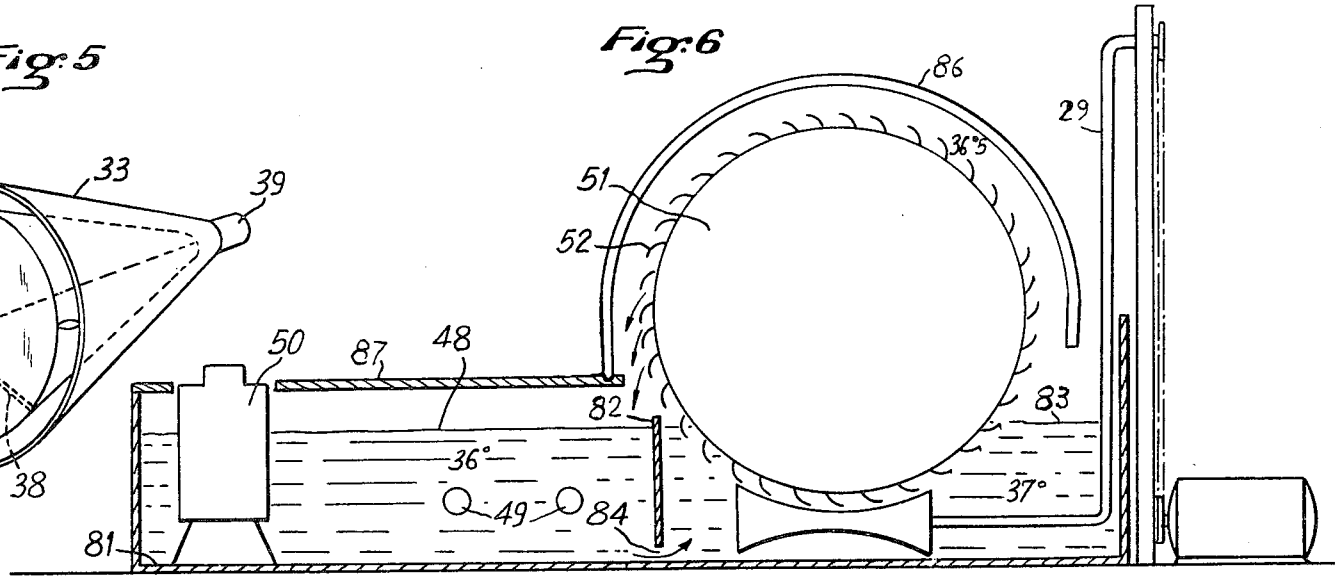
Figure 5:
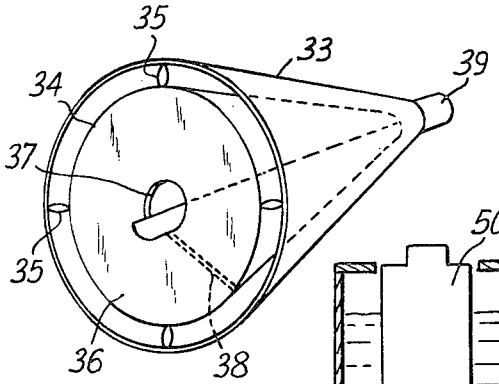

The drawings:

FIG. 1 is a schematic view in vertical section illustrating the charging with processing liquid of an apparatus implementing the process, FIG. 2 shows of the apparatus during the simultaneous transfer of the baths from one compartment to the immediately following one, FIG. 3 shows the apparatus after the transfer of the first bath into the compartment carrying the photographic material to be processed, FIG. 4 shows the diagrammatic cross-section of the aforementioned alternative construction of the apparatus implementing the process, FIG. 5 a perspective view of a temporary-holding tank of the apparatus shown in FIG. 4, FIG. 6 is a schematic end view of the apparatus partially immersed in a water-bath.

Figure 7:
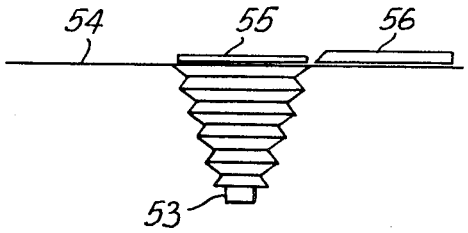
Figure 8:
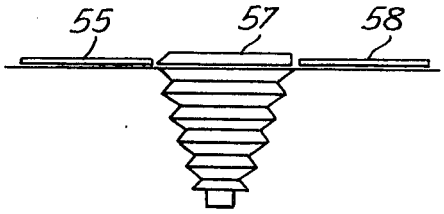
Figure 9:
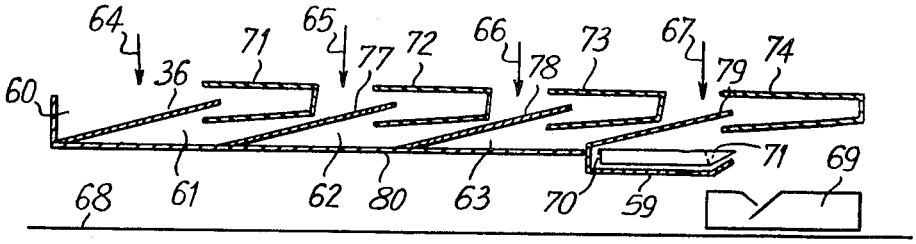
Figure 10:
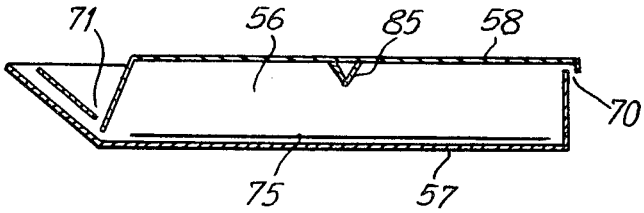
Figure 11:
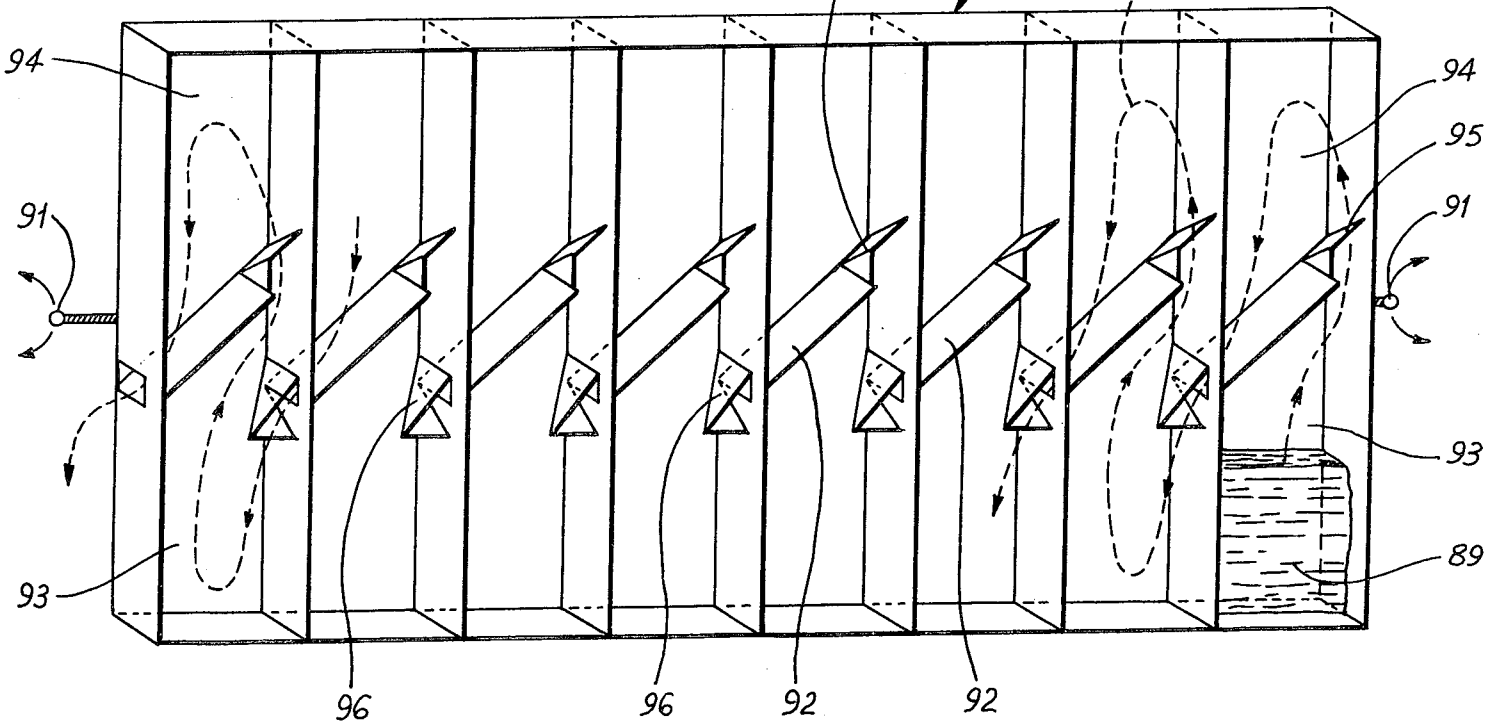

FIGS. 7 and 8 are schematic views of the focussing and exposing of photographic material processed by this method, FIG. 9 is a schematic view of a developing apparatus of the photographic material in a light-tight box FIG. 10 is a schematic view of a light-tight box for developing in full light, and FIG. 11 is a pictorial view of another construction.

One apparatus implementing the processing method by simultaneous transfer of the baths necessary to the processing of any photographic material is illustrated by FIGS. 1 to 3. In the embodiment shown the apparatus consists of an elongated body 1 comprising a certain number of intermediate compartments or receptacle 2, 3 and 4, an end processing compartment or receptacles 5 and an end compartment 6 for the receiving the last processing liquid.

Compartment 5, which can be made detachable, comprises apparatus for the insertion of the photographic material 7 to be processed. In particular, this could be a positive or negative sheet which must be processed in accordance with colour processing and the liquid chemicals used.

Once photographic material 7 has been inserted in total darkness in compartment 5, the baths shown schematically at 8,9, 10 and 11 can be introduced in full light, into the immediately following compartments 6, 2, 3, and 4 through apertures 12 to 15. These are fitted with stoppers and the baths are introduced by using simple containers such as 16, for example.

In addition, the apparatus can be fitted with a cam 29 driven by a cam shaft 28 in order to ensure the tilting of the body 1 from the position is shown in FIG. 1 to the position shown in FIG. 2. During this tilting all of the baths 8 to 11 are simultaneously transferred. Each compartment drains off through respective apertures or outlets 16 to 19 provided in partitions 20 to 23 into a temporary-holding tank or additional receptacle as shown by 24 to 27.

When cam 29 follows its course, body 1 returns to a horizontal position, and baths 8 to 11 drain from the temporary-holding tanks to below the levels of outlets 16 to 19 onto the beds of compartments 2 to 5 respectively, as shown in FIG. 3.

The liquid chemical having reached compartment 5 where the photographic material 7 is, it is sufficient to leave the photographic material in contact with the liquid for the required period of time before tilting the tank again. In the course of this tilting, liquid 11 flows out via deflectors 30 placed at the far side of end compartment 5 so that it drains off into dish 31 placed on bearer 32. During this draining off period, baths 8, 9 and 10 move respectively into temporary-holding tanks 25, 26 and 27, in such a way that after being returned to horizontal position, photographic material 7 is in contact with bath 10. Once the period of time allocated for contact between liquid 10 and photographic material 7 is over, a new driving motion of cam 29 enables bath 10 to drain off and to be replaced by bath 9.

When the last bath 8 has been introduced thanks to the same simple tilting of the tank and is completed, photographic material 7 can be removed after a specific length of time.

Thus, even without the help of a motor, such an apparatus is easy to operate as it can be tilted with the use of a simple crank.

It seems obvious that it is extremely simple to adapt any type of programmer to operate the driving motor of driving cam 28. This programmer would operate the motor at predetermined intervals which would be set according to the chemical liquids used and according to the temperature of the baths. Thus is constructed an extremely flexible apparatus, particularly reliable thanks to the absence of any complex means of operation.

Moreover, when the constructed tank is in its horizontal position, it is possible to drive it into a rotating motion around its axis so as to sweep the surface of the paper being processed without ill-timed agitation.

Advantage can be taken of this rotating motion to bring temporary-holding tanks and partitions closer together. This is achieved by partially blocking each temporary-holding tank and by rotating the whole body so that each tank drains into its own compartment, whilst avoiding any flowing back of the liquid into the preceding compartment.

Such an outline is shown in FIG. 4 and each temporary-holding tank is illustrated as in FIG. 5.

In this figure it is noticeable that wall 33 of the temporary-holding tank is cone-shaped. It also comprises an internal conical wall 34 making up the wall of the temporary-holding tank itself.

This internal wall is kept at a certain distance from wall 33 with the help of small brackets 35. An end partition 36 bored through in its centre 37 enables temporary-holding tank 34, to still retain the liquid received after tank 1 is returned to its horizontal position. As the tank is rotated, a longitudinal triangular pale 38 constituting baffle means makes it possible for the liquid chemicals, received through aperture 39 of the external wall of the preceding compartment, to be poured out into the compartment corresponding to temporary-holding tank 34.

So, when a chemical liquid 40 has been poured through aperture 41 of the cone-shaped end compartment 42, this liquid runs out in 37 by flowing over from pale 38 when the latter is brought to a horizontal position. When the body is tilted for a second time, liquid 40 runs into space 43 between cone-shaped walls 33 and 34 and fills up the following temporary-holding tank 44.

When the body is returned to its horizontal position, liquid 40 drains off into compartment 45, as the tank is rotated around its axis. As the space between the compartments is reduced, the length of end processing compartment 46 can be increased to make room for large size photographic material occupying the whole length 47, as well as for standard units used for small format.

These outlines can clearly offer several alternatives: for example, wall 34 could be fitted with helicoidal threads used to empty this temporary-holding tank while it is being rotated.

The apparatus which regulates the temperature is illustrated in the diagram by resistances 49; the flasks containing the various chemical liquids are shown in diagram 50. The end face 51 of the tank has been drawn to show a series of little longitudinal blades or fins 52 placed all along the wall of the tank. They make it possible to drive a fully protective layer of water around the tank. This layer of water protects the wall from any sudden change of temperature between the bath and the external environment. Thus, maintainance of temperature inside the partitioned tank is greatly improved. The tank, in its horizontal position, and while partially immersed in the temperature controlling water, as shown in FIG. 6, can be rotated about its axis by spaced apart motor driven rollers (not shown) which cradle the tank, as is well known in this field, and can, for example, be of the type disclosed in U.S. Pat. Nos. 3,982,259 and 3,668,997.

As the process is applicable to any photographic material and, consequently, to any positive paper capable of reproducing a reversible picture, such as transparency slides, the apparatus described can be compact. Thus, it is possible to construct this apparatus in the form of a portable colour-photocopier.

As an example, an ordinary lens 53 on an exposure-bed 54 is shown in FIGS. 7 and 8. A piece of frosted glass 55 enables the focussing of the desired picture. Following the focussing operation, case 57 of light-tight box 56 is slid to the position previously occupied by the frosted glass 55, as shown in FIG. 8. This case contains the unexposed paper. Once the desired exposure is achieved, a slide-bar or dark slide shutter lid 58 is pushed back into the case to seal light-tight box 56 once more. This light-tight box can be of the disposable or reusable type and has non corrosive properties. Contrary to the previous methods used in photocopying processes, it is the light-tight box housing the exposed print which is placed in end compartment 59 FIG. 9 of an apparatus similar to the one shown in FIG. 1. The flat bases of compartments 60, 61, 62 and 63 receive respectively the rinse, the fixing bath, the bleaching bath and the developer. These chemical liquids are poured in daylight above partitions 76 to 79 of the compartments in forefront positions 64 to 67 of each temporary-holding tank 71 to 74. Table 68 may bear automatic equipment which enables the whole of body 80 to be tilted. This equipment could be operated by a suitable programmer. When apparatus 80 is first tilted, the developer introduced in position 67 passes from compartment 63 into temporary-holding tank 74; then, when the body is returned to its horizontal position, the developer moves to end compartment 59 which houses light-tight box 56. Besides comprising a standard slide-bar, the light-tight box can also comprise outlets fitted with deflectors. These act as protection against light whilst still allowing the developer to travel easily over the whole surface of the paper housed in the box. These outlets can be constructed along sides 70 and 71 of the box.

After the period necessary for contact between paper and developer, apparatus 80 is tilted again to enable the developer to drain off into container 69 and the bleaching bath to be introduced into temporary-holding tank 74. Consequently, the return to horizontal position effects the draining off of this bath into compartment 59 which houses light-tight box 56. From then on, the same pattern of operation is followed to apply the fixer and then the rinse. The fact that the compartments are level and no longer in the shape of a tank is particularly convenient when dealing with photographic material of uniform size, for example of photographic material with a 21×29. 7 cm format.

Light-tight box 56 is illustrated in FIG. 10 together with photographic material 75 in the position it occupies when placed in a developing compartment in accordance with the process. It is clear that spaces 70 and 71 between lid 58 and case 57 which houses photographic material 75, enable the liquid to flow into the light-tight box and to drain off when the box, together with the apparatus, is tilted.

Any colour reproduction of material by photocopying method can thus be done in full light, as the apparatus implementing the process is particularly simple and entirely reliable.

The example, illustrated by FIG. 11, shows in position 88 the course followed by chemical liquid 89 throughout the successive tilting motions of tank 90 around axis 91. Intersection lines 92 of the partitions which separates two compartments 93, 94, slightly on each side of axis 91, represent natural draining courses.

These, in turn, channel the liquid chemical towards apertures or deflectors 95 which give access to compartments 94, then towards apertures or deflectors 96 which give access to neighbouring compartments 93, slightly set off length-wise. The deflectors can present themselves more particularly in the shape of spouts or small inclined planes. The last deflector 96 gives access to the container housing the photographic material. This is done by means of an inlet into which the successive liquid chemicals flow by force of gravity, whilst the container drains itself off between each bath.

It is obvious that one would remain within the framework of this invention if the various parts described were to be replaced by their equivalents. The same could be said if, one way or another, alterations were made, provided they did not change the nature of the process which involves the channelling of liquid chemicals for one compartment to another, by means of simple rotating or sliding tilting motions, as implemented by cam 29.

Thus, one can design any part which would serve to introduce positive or negative material into the end container, which can be made detachable if so desired. The same can be done with the bearers and the guidebars inside the end compartment itself, to allow for the housing of a specific quantity of photographic material of either uniform or different format. In particular, the guiding apparatus can be designed for developing any picture mount, such as paper, sheets or film-rolls which are loaded into the appropriate apparatus. However, the tanks housing these picture mounts should preferably be modules, as to enable materials of different format to be processed with a minimum amount of liquid.

Similarly, the apparatus regulating temperature, which is diagrammatically illustrated by resistances 49, can comprise any particular type of safety apparatus, such as: the automatic releasing of battery supply in case of mains' power-failure, as resistances 49 are distributed to ensure perfect regulation, in accordance with the movement of water in tank 31. This tank can, in particular, be fitted with partitions able to regulate the flow of re-heated water, and prevent the water which is to be re-heated from mixing too quickly with the water which has already reached the desired temperature.

In the example shown in FIG. 6, partition 82 prevents the water flowing out of blades 52 from flowing back into area 83 without first going through the re-heating area. The transfer from the re-heating area into area 83 is made through a gap 84 created under the lower part of wall 82.

One would also remain within the framework of the invention, if additional deflectors were affixed to the light-tight boxes fitted with an ordinary safety-device, such as 85, to prevent any accidental opening. These deflectors would further prevent any penetration of light in 70 and/or in 71 where the processing liquid flows.

I claim:

1. A method of processing material requiring successive liquid baths comprising, placing material to be processed in a processing receptacle, filling processing liquids into at least first, second, and third receptacles, simultaneously moving the first, second, and third receptacles to a first position to simultaneously transfer the liquids from the first receptacle to the processing receptacle, the second receptacle to a fourth receptacle, and the third receptacle to a fifth receptacle, simultaneously moving the fourth and fifth receptacles to a second position to simultaneously transfer liquid from the fourth receptacle to the first receptacle, and from the fifth receptacle to the second receptacle, draining liquid from the processing receptacle, and again moving the first second and third receptacles to the first position, and the fourth and fifth receptacles to the second position, to transfer the liquids one by one into the processing receptacle.

2. A method according to claim 1 in which said step of placing the material to be processed in a processing receptacle comprises placing the material in a light-tight processing receptacle.

3. A method according to claim 1, wherein said step of placing material to be processed in a processing receptacle comprises placing the material in a light-tight box, placing the box in the processing receptacle, and keeping the material in the box during processing with the successive liquid baths.

4. Apparatus for processing photographic material requiring a plurality of liquid baths comprising, a moveable body having a processing receptacle and a plurality of intermediate receptacles upstream of the processing receptacle for containing liquids to be transferred one by one to the processing receptacle, said processing receptacle comprising means for receiving photographic material to be processed, each receptacle having an outlet, each of said receptacles comprising means for containing a predetermined level of liquid therein below said outlet, in a first position of said body, means in each receptacle for directing liquid toward the receptacle outlet and emptying the receptacle in response to movement of said body to a second position in which the outlet of each receptacle is below the liquid therein, a plurality of additional receptacles, one adjacent an outlet of each of said intermediate receptacles, said additional receptacles each comprising means for receiving liquid from the outlet of an upstream intermediate receptacle in response to movement of said body toward said second position, and for discharging the received liquid into the next receptacle, in said first position of said body.

5. Apparatus according to claim 4 wherein, said means in each intermediate receptacle for directing liquid toward the receptacle outlet comprises a wall of the receptacle sloping toward the outlet.

6. Apparatus according to claim 5 wherein, said body comprises an elongated cylindrical body, and said wall of each intermediate receptacle comprises a conical wall.

7. Apparatus according to claim 5 wherein said processing receptacle comprises an end receptacle of the body.

8. Apparatus according to claim 6 wherein, one of said additional receptacles is within the processing receptacle, and the other additional receptacles are within the intermediate receptacles.

9. Apparatus according to claim 6 wherein, each intermediate receptacle comprises a cylindrical container, said processing receptacle comprises a cylindrical container, and said body is rotated about a longitudinal axis during processing of the material in said processing container.

10. Apparatus according to claim 9 further comprising fins for receiving liquid of a liquid bath in which the container is rotated to maintain the liquids in said body at a contant temperature.

11. Apparatus according to claim 9 further comprising means for maintaining the temperature of a liquid in which the body is rotated relatively constant during processing of material in said processing receptacle.

12. Apparatus according to claim 6 further comprising baffle means in each additional receptacle for discharging liquid therefrom in response to rotation of said body after movement of said body to said first position.

13. Apparatus according to claim 4 wherein, said intermediate receptacles are arranged one adjacent the other along the length of the body, and said additional receptacles are arranged one adjacent each other along the length of the body and beside the intermediate receptacles.

14. Apparatus according to claim 4 wherein, said additional receptacles are each between respective intermediate receptacles.

15. Apparatus for processing photographic material requiring a plurality of liquid baths comprising, a movable body and a processing receptacle, said movable body including a plurality of intermediate receptacles for containing liquids to be transferred one by one to the processing receptacle, said processing receptacle comprising means for receiving photographic material to be processed, each intermediate receptacle having an outlet, each of said intermediate receptacles comprising means for containing a predetermined level of liquid therein below said outlet, in a first position of said body, means in each intermediate receptacle for directing liquid toward its outlet and emptying the receptacle in response to movement of said body to a second position in which the outlet of each intermediate receptacle is below the liquid therein, a plurality of additional receptacles, one adjacent an outlet of each of said intermediate receptacles, said additional receptacles comprising means for receiving liquid from the outlet of an upstream intermediate receptacle in response to movement of said body toward said second position, and for discharging the received liquid respectively into the next intermediate receptacle and the processing receptacle, in said first position of said body.

* * * * *